US009364724B2

(12) United States Patent
Motokawa

(10) Patent No.: US 9,364,724 B2
(45) **Date of Patent: *Jun. 14, 2016**

(54) GOLF CLUB

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/305,084

(22) Filed: Jun. 16, 2014

(65) Prior Publication Data

US 2015/0005093 A1 Jan. 1, 2015

(30) Foreign Application Priority Data

Jul. 1, 2013 (JP) ..... 2013-138242

(51) Int. Cl.
*A63B 53/02* (2015.01)
*A63B 53/06* (2015.01)
*A63B 53/04* (2015.01)

(52) U.S. Cl.
CPC ..... *A63B 53/02* (2013.01); *A63B 53/0466* (2013.01); *A63B 2053/0491* (2013.01); *A63B 2209/00* (2013.01)

(58) Field of Classification Search
CPC ..... A63B 53/02; A63B 53/0466; A63B 2053/0491; A63B 2209/00; A63B 2053/021; A63B 2053/022; A63B 2053/023; A63B 2053/025; A63B 2053/026; A63B 2053/027
See application file for complete search history.

(56) References Cited

U.S. PATENT DOCUMENTS

| | | | | |
|---|---|---|---|---|
| 2,067,556 | A * | 1/1937 | Wettlaufer | A63B 53/02 473/244 |
| 3,556,533 | A * | 1/1971 | Hollis | A63B 53/04 411/900 |
| 3,692,306 | A * | 9/1972 | Glover | A63B 53/02 473/306 |
| 4,043,563 | A * | 8/1977 | Churchward | A63B 53/08 473/338 |
| 4,869,507 | A * | 9/1989 | Sahm | A63B 53/04 473/337 |

(Continued)

FOREIGN PATENT DOCUMENTS

JP 2012-86010 A 5/2012

*Primary Examiner* — Stephen Blau
(74) *Attorney, Agent, or Firm* — Birch, Stewart, Kolasch & Birch, LLP

(57) ABSTRACT

A golf club includes a golf club head provided with a first hole and a second hole on its bottom side, a shaft, a first fastener detachably attached to the first hole to detachably fix the shaft to the golf club head, and a second fastener detachably attached to the second hole to provide weight on the golf club, the second fastener having weight different from that of the first fastener. The first fastener and the second fastener are configured as mutually replaceable fasteners so that the first fastener is detachably attached to the second hole and the second fastener is detachably attached to the first hole to detachably fix the shaft to the golf club head.

6 Claims, 10 Drawing Sheets

(56) References Cited

U.S. PATENT DOCUMENTS

| | | | | |
|---|---|---|---|---|
| 4,934,703 | A * | 6/1990 | Delaney | A63B 53/04 273/DIG. 3 |
| 5,388,827 | A * | 2/1995 | Reynolds, Jr. | A63B 53/02 473/288 |
| 5,533,725 | A * | 7/1996 | Reynolds, Jr. | A63B 53/02 473/307 |
| 5,540,435 | A * | 7/1996 | Kawasaki | A63B 53/02 473/309 |
| 7,300,359 | B2 * | 11/2007 | Hocknell | A63B 53/00 473/309 |
| 8,147,350 | B2 * | 4/2012 | Beach | A63B 53/02 473/307 |
| 8,235,835 | B2 * | 8/2012 | Soracco | A63B 53/02 473/307 |
| 8,636,607 | B2 * | 1/2014 | Renna | A63B 53/0487 473/340 |
| 2012/0071261 | A1 | 3/2012 | Yamamoto | |
| 2014/0162806 | A1 * | 6/2014 | Kitagawa | A63B 53/02 473/307 |
| 2015/0005097 | A1 * | 1/2015 | Motokawa | A63B 53/0466 473/338 |
| 2015/0018122 | A1 * | 1/2015 | Serrano | A63B 53/06 473/342 |
| 2015/0209628 | A1 * | 7/2015 | Boyd | A63B 53/04 473/342 |

* cited by examiner

GOLF CLUB

BACKGROUND OF THE INVENTION

1. Field of the Invention

The present invention relates to a golf club including a golf club head and a shaft detachably attached to the golf club head, and in particular to a golf club that may flexibly adjust a location of the center of gravity of the golf club head.

2. Description of the Related Art

The Japanese Unexamined Patent Application Publication No. 2012-86010 discloses a golf club including a golf club head and a shaft detachably attached thereto. The golf club, for instance, includes a hosel having a shaft insertion hole having an upper opening into which a tip end of the shaft is inserted. The shaft insertion hole further has a lower opening as a first hole where a fastener for fixing the shaft to the golf club head is fastened. The golf club described above has advantage of offering an opportunity to exchange the shaft or golf club head by the golfer.

SUMMARY OF THE INVENTION

The present invention has a main object of providing a golf club having a feature for adjusting the location of center of gravity of the golf club head without deteriorating flexibility in the design of the club head.

According to one aspect of the invention, a golf club includes a golf club head provided with a first hole and a second hole on its bottom side, a shaft, a first fastener detachably attached to the first hole to detachably fix the shaft to the golf club head, and a second fastener detachably attached to the second hole to provide weight on the golf club, the second fastener having weight different from that of the first fastener. The first fastener and the second fastener are configured as mutually replaceable fasteners so that the first fastener is detachably attached to the second hole and the second fastener is detachably attached to the first hole to detachably fix the shaft to the golf club head.

In another aspect of the invention, the golf club head may comprise a tubular hosel provided with a shaft insertion hole having an upper opening for insertion of the shaft into the golf club head, and a lower opening on the bottom side of the head, and a shaft sleeve adaptor having a first thread portion and inserted into the shaft insertion hole so as to receive a tip end of the shaft, the first hole comprises a space extending from the lower opening of the shaft insertion hole toward the first thread portion of the shaft sleeve adaptor, and each of the first fastener and the second fastener comprises a second thread portion that engages with the first thread portion.

In another aspect of the invention, the first thread portion of the shaft sleeve adaptor may be configured as a male thread, and the second thread portion is configured as a female thread.

In another aspect of the invention, the second hole may comprise an outer portion having a circumferential inner surface including at least one first corner, and an inner portion having a circumferential inner surface including at least one second corner arranged in different place with respect to the first corner in a circumferential direction of the second hole, and the second fastener comprises a flange configured so that the flange firmly engages with the second corner of the inner portion of the second hole by rotating around a central axis of the second hole after passing the outer portion of the second hole.

In another aspect of the invention, the golf club head may comprise a hitting face for hitting a golf ball, and the first hole and the second hole are spaced at substantially the same distance from the hitting face.

In another aspect of the invention, the first hole may be provided with a third thread portion which is coaxially arranged in a different place with respect to the first thread portion, each of the first fastener and the second fastener comprises a fourth thread portion, and the fourth thread portion is coaxially arranged in a different place with respect to the second thread portion to engage with the third thread portion.

In accordance with the present invention, golfers may exchange the positions of the first fastener for fixing the shaft to the golf club head and the second fastener for providing weight on the golf club head. In other words, the first hole for detachably attaching the shaft to the club head may be used as one of the holes for adjusting the center of gravity of the club head.

Thus, the present invention may provide a golf club that may offer the weight adjustment feature of the club head and a shaft detachable feature while reducing the number of second holes on its bottom side so that the flexibility in the design of the club head is improved. This advantage is more effective with respect to the fairway wood-type golf club head having a small volume.

DETAILED DESCRIPTION

An embodiment of the present invention will be explained below with reference to the accompanying drawings.

Figure 1:
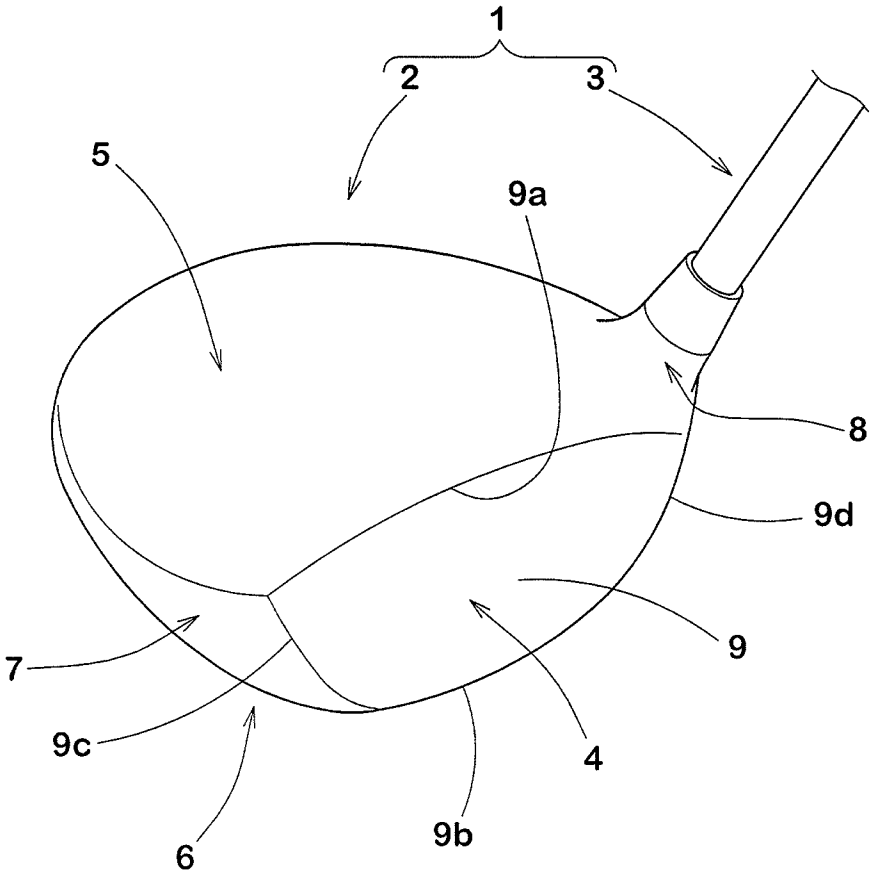
FIG. 1 is a perspective view illustrating a golf club in accordance with an embodiment of the present invention.

FIG. 1 is a perspective view illustrating a golf club 1 in accordance with an embodiment of the present invention. The golf club 1 includes a golf club head (which may be hereinafter simply referred to as a "head") 2, and a shaft 3 that is detachably attached to the golf club head 2.

The head 2 in accordance with the present embodiment is configured as a wood type having a hollow (i) (shown in FIG. 2) provided therein. A concept of the wood-type golf club head is such that it includes at least Driver (#1), Brassy (#2), Spoon (#3), Baffy (#4), and Cleek (#5), and also includes heads which differ from them in the count number or a name but has an almost similar shape thereto. In another aspect of the present invention, the head 2 may be configured as an iron-type, a utility-type, or a putter-type.

The major part of the head 2 is preferably made of a metal material such as stainless steel, maraging steel, titanium, titanium alloy, magnesium alloy or aluminum alloy. For the head 2, plurality kinds of metal materials may be used. The head 2 may be partially made of a non-metal material such as fiber reinforced resin.

Referring back to FIG. 1, the head 2 includes a face portion 4, a crown portion 5, a sole portion 6, a side portion 7, and a hosel 8.

The face portion 4 includes a hitting face 9 for striking a golf ball. The hitting face 9 has an upper edge 9*a*, a lower edge 9*b*, a toe-side edge 9*c*, and a heel-side edge 9*d*. The crown portion 5 extends rearward from the upper edge 9*a* of the hitting face 9 so as to form a top surface of the head 2. The sole portion 6 extends rearward from the lower edge 9*b* of the hitting face 9 so as to form a bottom surface of the head 2. The side portion 7 extends from the toe-side edge 9*c* of the hitting face 9 to the heel-side edge 9*d* of the hitting face 9 through a rear of the head in between the crown portion 5 and the sole portion 6. Regarding the front-rear direction of the head 2, the front of the head 2 means the side which is near the hitting face 9, and the rear means the side apart from the hitting face 9.

Figure 2:
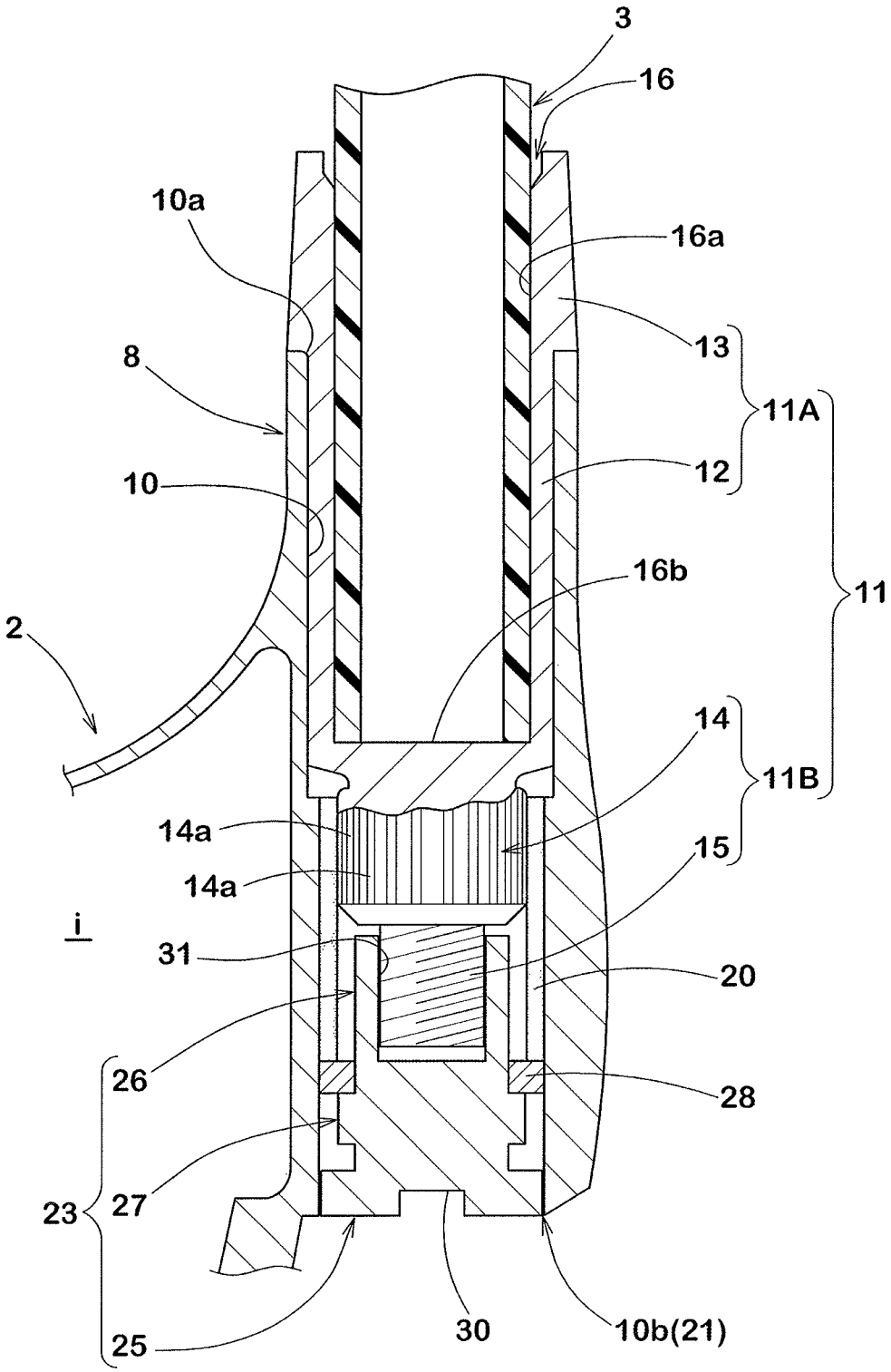
FIG. 2 is a cross-sectional view of a connected portion of a golf club head and a shaft.

The hosel 8 is provided on the heel side of the crown portion 5. FIG. 2 illustrates the cross-sectional view of the hosel 8. The hosel 8 is formed into a tubular shape having a shaft insertion hole 10. The shaft insertion hole 10 is a through hole that comprises an upper opening 10*a* for insertion of the shaft 3 into the head 2, and a lower opening 10*b* that opens on the sole portion 6 (shown in FIG. 1).

In the shaft insertion hole 10, a support pipe 20 made of metal material is bonded by welding, for instance. The support pipe 20 comprises an outer surface fitted on the shaft insertion hole 10, and an inner surface being alternately provided with ridges and grooves which extend in an axial direction of the pipe so as to form splines.

The shaft 3 is made of a fiber reinforced plastic, for instance. The shaft 3 is formed into a pipe shape having a tip end to which a shaft sleeve adaptor 11 is attached.

The shaft sleeve adaptor 11 is made of a metal material. The shaft sleeve adaptor 11 comprises a sleeve body 11A into which the shaft 3 is inserted, and an axial portion 11B integrally formed below the sleeve body 11A.

The sleeve body 11A is formed into a pipe shape that has an axially extending bore 16. The bore 16 is configured as an upper opened hole defined by an inner surface 16*a* and a closed bottom surface 16*b*. The shaft 3 is previously bonded to the bore 16 by using adhesive agent, for example.

The sleeve body 11A integrally includes a first portion 12 inserted into the hosel 8, and a second portion 13 exposed outside the hosel 8. The second portion 13 includes a conical outer surface having a diameter for engaging the top of the hosel 8.

The shaft sleeve adaptor 11 with the shaft 3 is inserted in the shaft insertion hole 10 of the hosel 8 from the upper opening 10*a*. Thus, the shaft 3 is assembled to the head 2. Since the second portion 13 of the sleeve body 11A may engage with the top of the hosel 8, the shaft sleeve adaptor 11 stays a certain position when it is inserted.

The axial portion 11B of the shaft sleeve adaptor 11 integrally includes a spline portion 14, and a first thread portion 15.

The spline portion 14 comprises axially extending ridges 14*a* and grooves alternately around its outer surface. The spline portion 14 of the shaft sleeve adaptor 11 may engage with the splines of the inner surface of the support pipe 20. Thus, the shaft sleeve adaptor 11 with the shaft 3 is fixed to the head 2 without rotating around the central axis thereof.

The first thread portion 15 extends downwardly from the bottom of the spline portion 14. In this embodiment, the first thread portion 15 is configured as a male thread (external thread) that is provided with a screw grooves around its outer surface. The first thread portion 15 has an outer diameter smaller than that of the spline portion 14.

Figure 3:
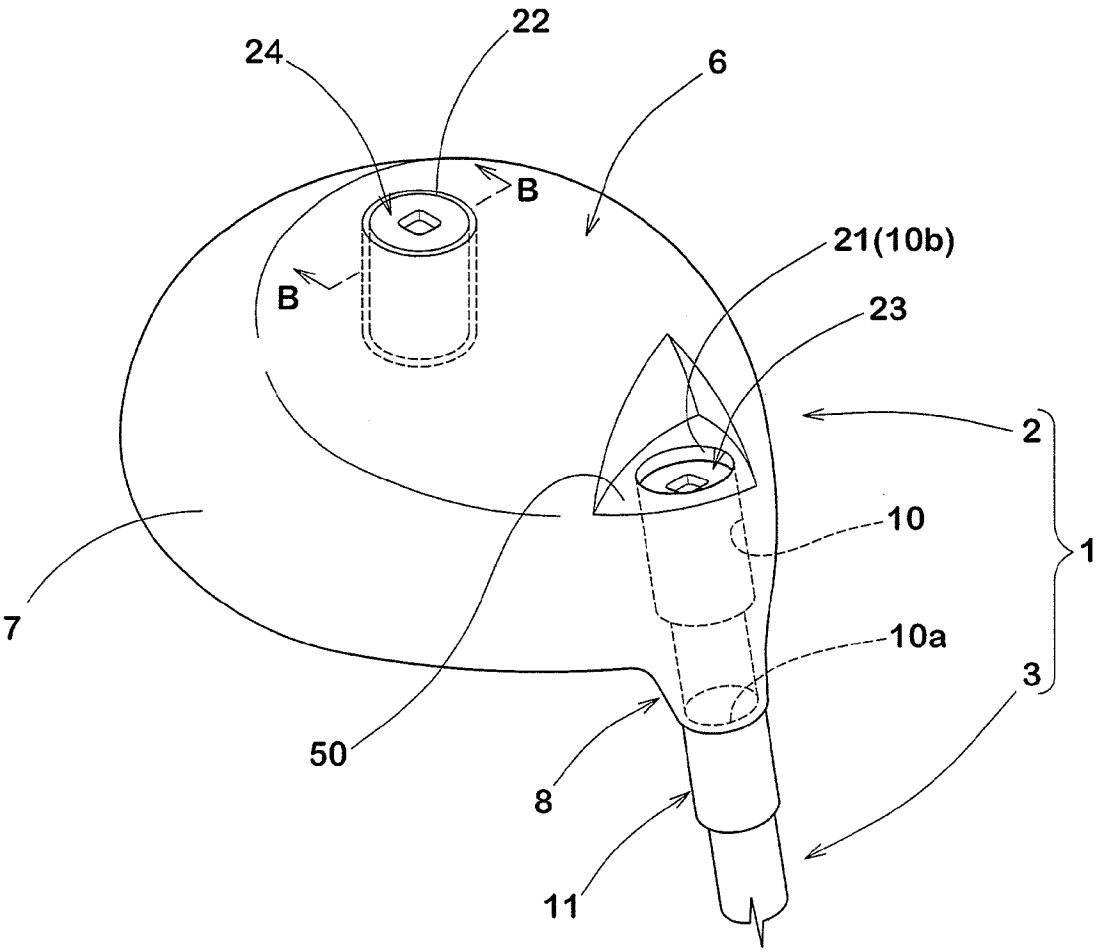
FIG. 3 is a perspective view of the golf club viewed from a bottom side of the golf club head.
Figure 4:
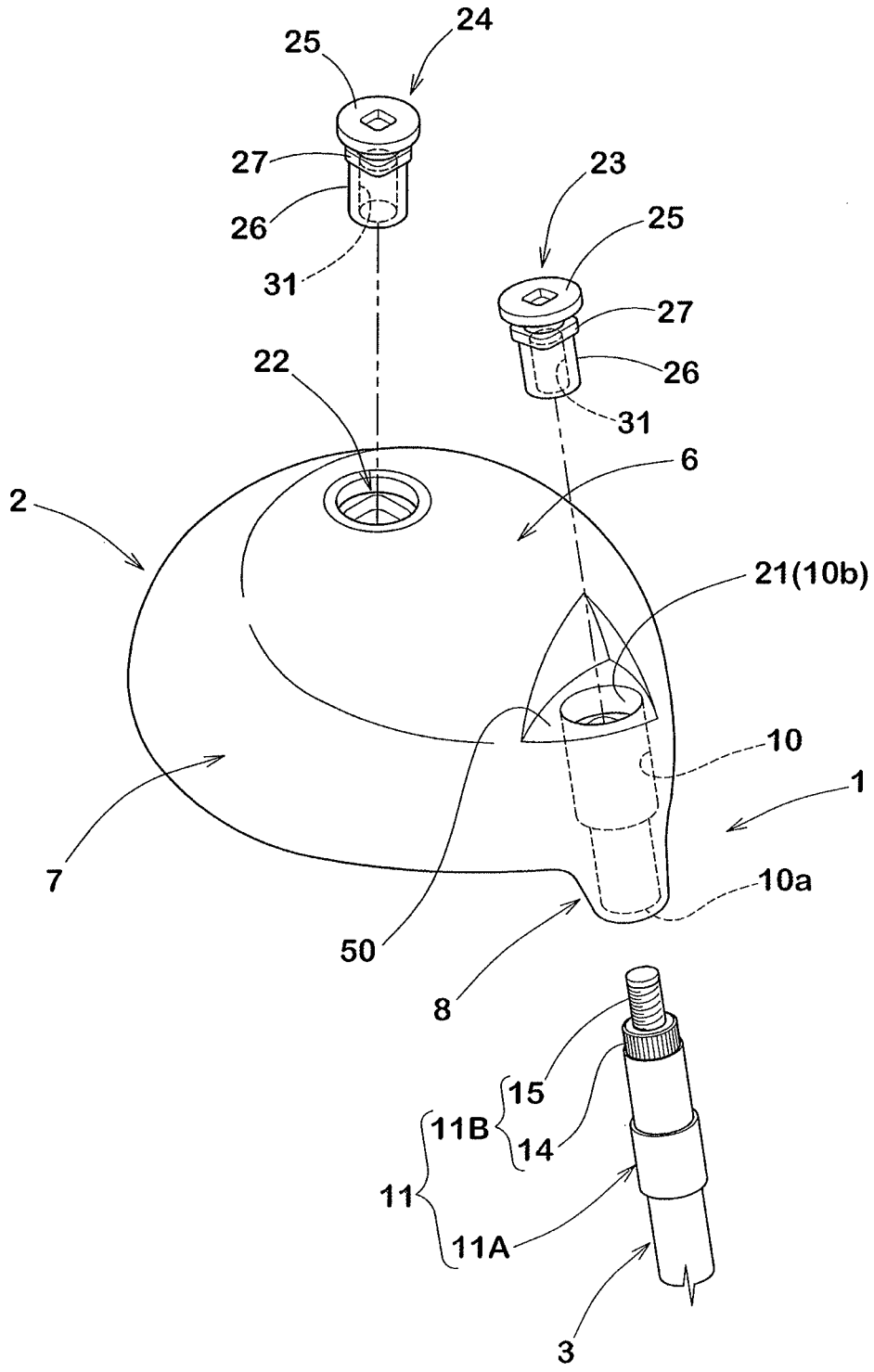
FIG. 4 is an exploded perspective view of the golf club of FIG. 3.

FIG. 3 illustrates a perspective view of the golf club 1 viewed from a bottom side of the golf club head, and FIG. 4 illustrates an exploded perspective view of FIG. 3. As shown in FIGS. 2 to 4, the head 2 is provided on the bottom side with a first hole 21 and a second hole 22.

Referring to FIGS. 2 and 3, the first hole 21 is configured as a space extending upwardly from the lower opening 10*b* of the shaft insertion hole 10 toward the first thread portion 15 of the shaft sleeve adaptor 11. Thus, the first hole 21 is provided at the heel side of the head 2. As shown in FIG. 4, the sole portion 6 includes a recess 50 on its heel side where the first hole 21 in accordance with the present embodiment is provided.

The second hole 22, for instance, is provided on the toe side of the head. Although one second hole 22 is provided in this embodiment, a plurality of second holes 22 may be provided if the flexibility in the design of the head 2 allows it.

In the first hole 21, a first fastener 23 is detachably fastened to fix the shaft 3 to the head 2. In the second hole 22, a second fastener 24 is fastened to provide a certain weight on the head 2.

In this embodiment, the first fastener 23 and the second fastener 24 have substantially identical shape but have different mass. In this embodiment, the first fastener 23 is made of a material having a specific gravity different from that of the second fastener 24 to provide different mass with respect to the second fastener 24. Preferably, the first and second fasteners 23 and 24 are made of a metal material such as stainless steel, titanium, aluminum alloy, cupper alloy, or tungsten steel. A resin material may be used for the first fastener 23 or the second fastener 24.

Figure 5:
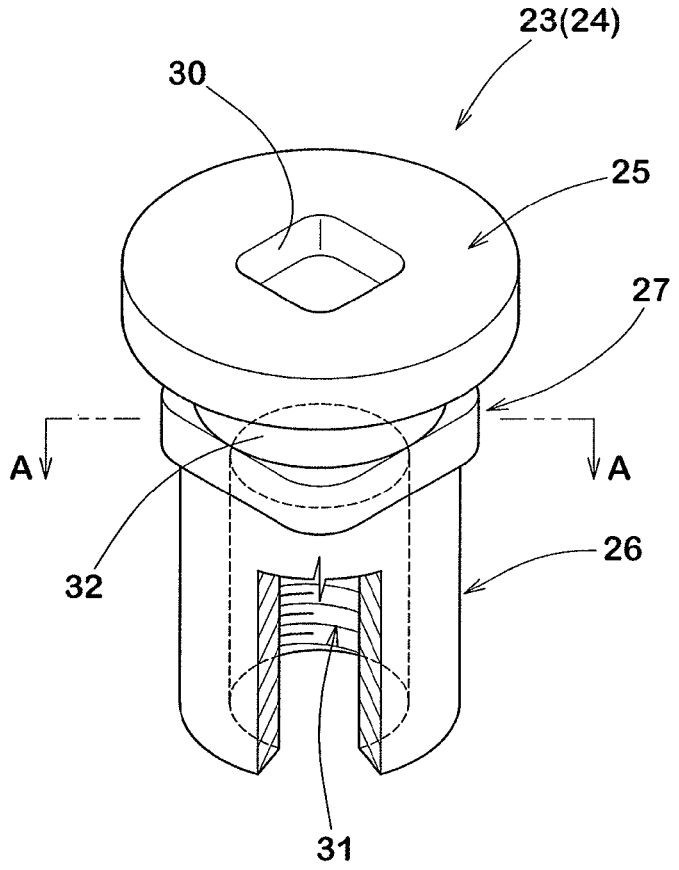
FIG. 5 is a perspective view of a first fastener.

FIG. 5 illustrates a perspective view of the first fastener 23 as a representative example. The second fastener 24 also has the identical shape with the first fastener 23. Referring to FIG. 5, the first fastener 23 is formed into a small shaft piece that comprises a head 25 located on the bottom side of the head 2 to form one end of the piece, a second thread portion 26 that forms another end of the piece, a flange 27 provided between the head 25 and the second thread portion 26, and a neck portion 32 provided between the flange 27 and the head 25.

The head 25 is configured as a circular piece with a socket 30 on its top for fastening the shaft 3 to the club head 2 by a tool such as a wrench. Although the shape of socket 30 is configured as a rectangular in this embodiment, any shapes such as a hexagon and star-shaped be used.

The second thread portion 26 is configured to a tubular shape having a female thread 31 (internal thread) for engaging the first thread portion 15 of the shaft sleeve adaptor 11.

Figure 6:
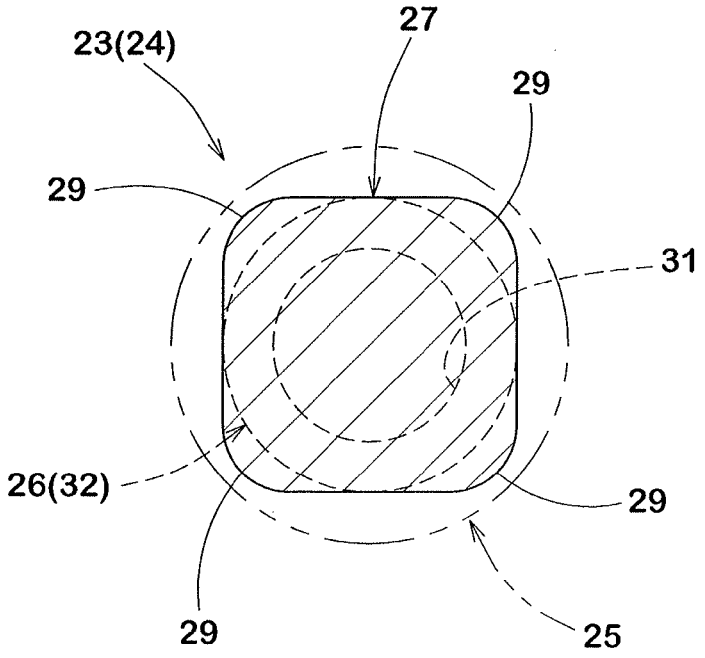
FIG. 6 is a cross-sectional view taken along line A-A in FIG. 5.

FIG. 6 illustrates a cross-sectional view of the flange 27 taken along line A-A in FIG. 5. As shown in FIGS. 5 and 6, the flange 27 is formed smaller than the head 25 but larger than the second thread portion 26. The flange 27 has at least one corner 29. In this embodiment, the flange 27 has a rectangular shape having four corners 29 each of which is chamfered. In this embodiment, the outlines of the second thread portion 26 and the neck portion 32 are inscribed inside the outline of the flange 27.

As shown in FIG. 2, the first fastener 23 fixes the shaft 3 to the head 2 using the first thread portion 26. The first fastener 23 is inserted into the first hole 21 and then the second thread portion 26 is screwed onto the first thread portion 15 of the shaft sleeve adaptor 11. By screwing the second thread portion 31 onto the first thread portion 15 of the shaft sleeve adaptor 11, the shaft sleeve adaptor 11 is forced downwardly because the upward movement of the first fastener 23 is limited by the support pipe 20 fixed to the hosel 8. Thus, the shaft 3 is firmly fixed to the hosel 8 through the shaft sleeve adaptor 11 which is acted high friction force between the second portion 13 and the top of the hosel 8. In this embodiment, a spring washer 28 is inserted between the flange 27 and the support pipe 20. In another aspect of the embodiment, the spring washer 28 may be replaced an internal flange integrally formed on the head 2, or a plane washer.

By removing the second thread portion 26 of the first fastener 23 from the first thread portion 15 of the shaft sleeve adaptor 11, the shaft sleeve adaptor 11 with the shaft 3 is able to be detached from the shaft insertion hole 10 of the hosel 8 of the head 2. Accordingly, the golf club 1 in accordance with the present invention may be easily detached the shaft 3 from the first hole 21 and exchanged, by only a simple operation of fastening and releasing the first fastener 23.

Figure 7:
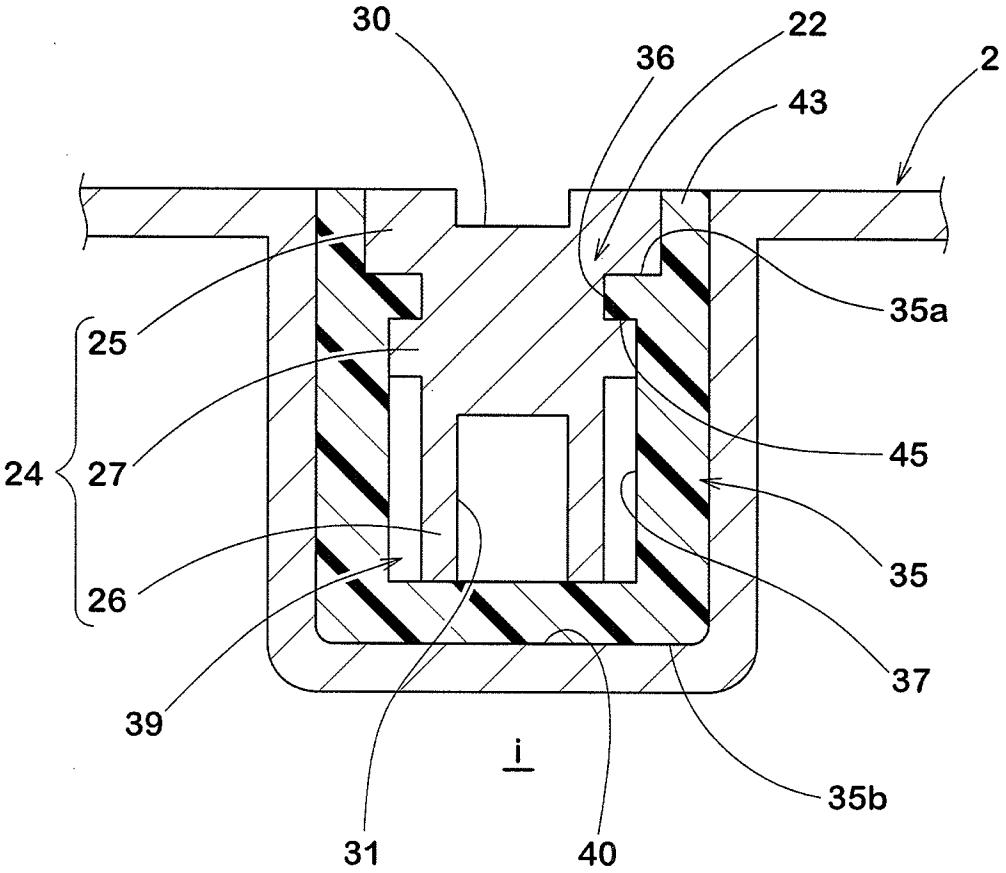
FIG. 7 is a cross-sectional view taken along line B-B in FIG. 3.

FIG. 7 illustrates a cross-sectional view of the second hole 22 taken along line B-B in FIG. 3. Referring to FIG. 7, the second fastener 24 is fastened to the second hole 22 to provide weight on the head 2. The second fastener 24 has the same configuration with the first fastener 23 described above. The second fastener 24 is attached to the second hole using its flange 27.

The second hole 22 comprises a recess 40, and an insert member 35 inserted into the recess 40. The insert member 35 has a cavity 39 to form the second hole 22. Preferably, the insert member 35 is made of relative soft elastic material such as resin, rubber and elastomer.

The insert member 35 comprises a first end 35*a* located outward of the head 2, and a second end 35*b* located on the opposite side of the first end 35*a*. In this embodiment, a circumferentially extending rib 43 protrudes outwardly from the first end 35*a*. The cavity 39 of the insert member 35 comprises an outer portion 36 having a circumferential inner surface, and an inner portion 37 having a circumferential inner surface. In this embodiment, the cavity 39 does not entirely pass through the insert member 35.

Figure 8A:
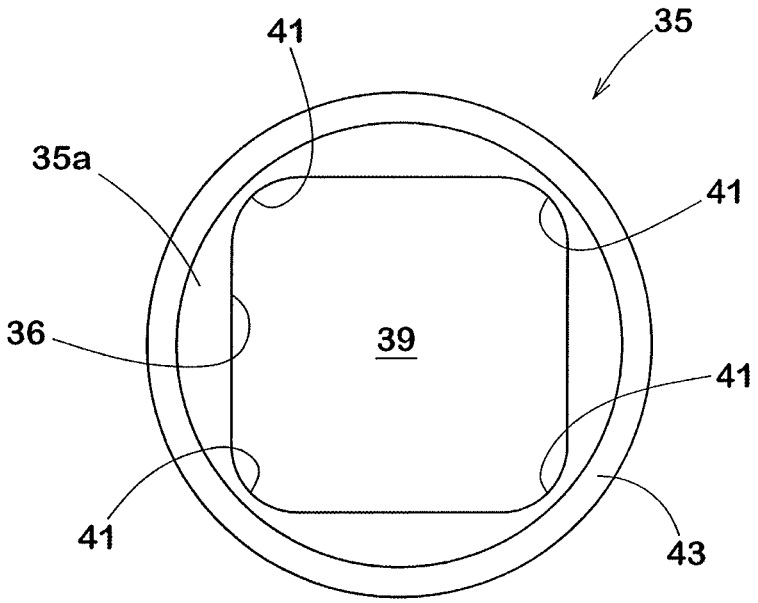
FIG. 8A is a plan view of a first end of an insert member.
Figure 9:
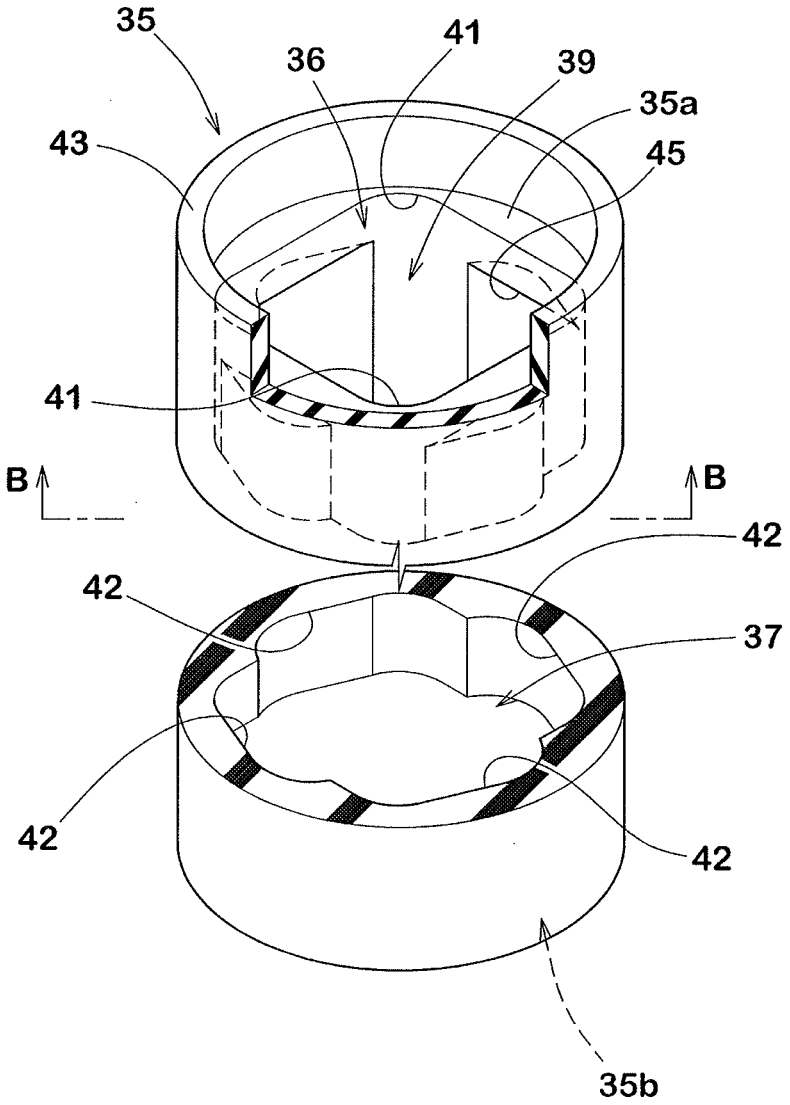
FIG. 9 is a perspective view of the insert member.
Figure 10:
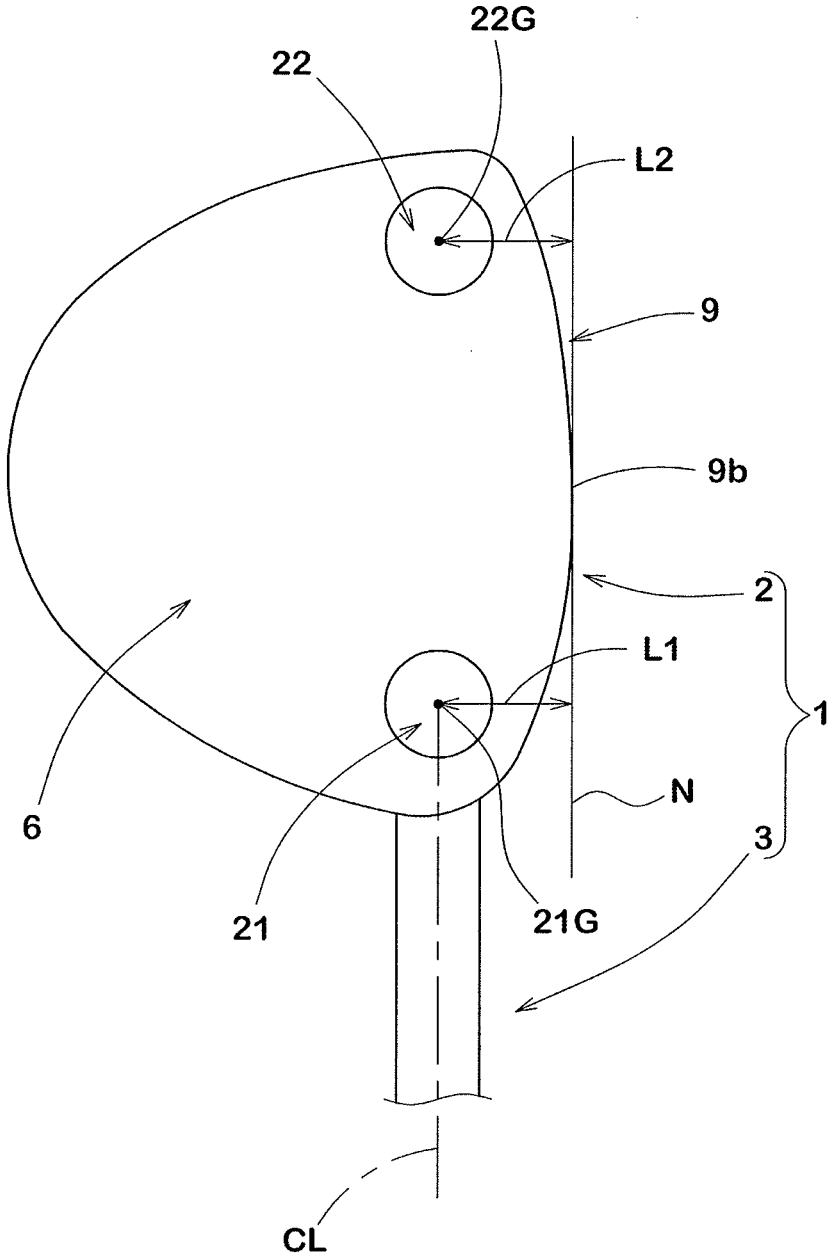
FIG. 10 is a bottom view of the golf club.

FIG. 8A illustrates a plan view of the insert member 35 viewed from the first end 35*a*, and FIG. 9 illustrates a perspective view of the insert member 35 viewed from the first end 35*a*. As shown in FIGS. 8A and 9, the outer portion 36 includes at least one first corner 41. In this embodiment, the outer portion 36 includes four first corners 41 so as to form a rectangular shape. The outline of the outer portion 36 is substantially same with the outline of the flange 27 of the second fastener 22 and is slightly large with respect to the outline of the flange 27 so that the flange 27 can pass through it.

Figure 8B:
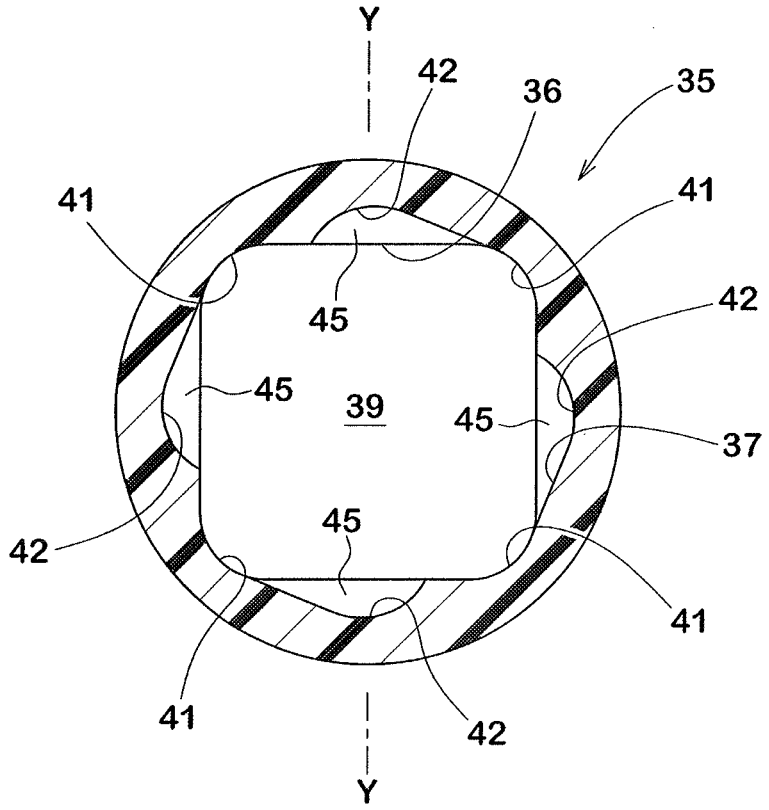
FIG. 8B is a plan views of the insert member viewed from direction B in FIG. 9.

FIG. 8B is a plan views of the insert member 35 viewed from direction B in FIG. 9. As shown in FIG. 8B and FIG. 9, the circumferential inner surface of the inner portion 37 includes at least one second corner 42 arranged in different place with respect to the first corner 41 in a circumferential direction of the second hole 22. In this embodiment, the inner portion 37 includes four second corners 42 each of which is shifted at an angle of 45 degrees around the central axis of the cavity 39 with respect to the respective first corners 41.

A stepped part 45 is provided between the outer portion 36 and inner portion 37.

When attaching the second fastener 24 to the second hole 22, the second fastener 24 is inserted into the second hole 22 from the bottom side of the head 2 by matching the direction of its flange 27 with the outline of the outer portion 36. After the flange 27 passes through the outer portion 36, the second fastener 24 is rotated around the central axis of the second hole 22 at angle of about 45 degrees in order to firmly lock it up to the second hole 22. Thus, each corner 29 of the flange 27 may move to engage with the corresponding respective second corner 42 of the inner portion 37 of the insert member 35 while elastically deforming the inner surface of the inner portion 37. Consequently, the second fastener 24 is locked to the second hole 22 by preventing from further turning movement around the central axis of the second hole 22.

FIG. 7 further corresponds a cross-sectional view of the second hole 22 taken along line Y-Y in FIG. 8B. As shown in FIG. 7, the second fastener 24 may further engage with the stepped portion 45 between the inner portion 37 and the outer portion 36 so that the second fastener 24 cannot be pulled out from the second hole 22. Furthermore, since the periphery of the head 25 of the second fastener 24 is surrounded by the rib 43, the second fastener 24 cannot come into contact with the head 2 directly. Consequently, contact noise between the second fastener 24 and the head 2 may be prevented when hitting a golf ball. Furthermore, since the rib 43 may offer a large contact area with the insert member 35, the bonding strength between the insert member 35 and the second hole 22 is improved. The second fastener 24 may be attached to the second hole 22 by a simple operation. In another aspect of the embodiment, a gap around the second thread portion 26 in the cavity 39 may be filled with an insert made of resin or metallic material.

When the second fastener 24 is detached from the second hole 22, the second fastener 24 is rotated around the central axis of the second hole 22 at angle of about 45 degrees in the opposite direction with respect to the locking operation described above. The rib 43 may allow such a rotational operation of the second fastener 24 due to a slight gap with respect to the head 25 of the second fastener 24. Each corner 29 of the flange 27 of the second fastener 24 is then released from the respective corresponding second corner 42 while elastically deforming the inner surface of the inner portion 37, and moves to a position matching the first corner 29 of the outer portion 36. Then the second fastener 24 is removed from the second hole 22. Thus the second fastener 24 is detachably attached to the second hole 22 by a simple operation.

As described above, the golf club 1 in accordance with the embodiment of the present invention comprises the first fastener 23 that is able to be detached from the first hole 21. Then the first fastener 23 detached from the first hole 21 is able to be fixed to the second hole 22. Similarly, the second fastener 24 is able to be detached from the second hole 22. Then the second fastener 24 detached from the second hole 22 is able to be fixed to the first hole 21 to fix the shaft 3 to the head 2.

Accordingly, the first fastener 23 for fixing the shaft 3 to the head 2 and the second fastener 24 for providing weight to the head 2 are able to be exchanged the respective positions. In other words, the first hole 21 for insertion of the shaft 3 to the head 2 may be used as a hole for providing mass to adjust the location of the center of gravity of the head 2 by exchanging the fastener to be attached thereto. Thus, the golf club 1 in accordance with the present embodiment may offer a feature for adjusting the center of gravity of the head 2 and a shaft detachable feature while reducing the number of second holes 22 for providing mass on its bottom side so that the flexibility in the design of the head 2 is improved. These are very effective advantage regarding to a fairway wood type golf club that has a small volume head.

Furthermore, each of the first fastener 23 and the second fastener 24 comprises two kinds of independent fixing means. Namely, each of the first fastener 23 and the second fastener 24 comprises the second thread portion 26 as a first fixing means which is used to fix to the first hole 21, and the flange 27 as a second fixing means which is used to fix to the second hole 22. However, the first and second fasteners 23 and 24 in accordance with the present invention are not particularly limited to the configuration described above.

In another aspect of the present invention, each of the first fastener 23 and second fastener 24 may have only one fixing means. For instance, the second hole 22 may be changed as a hole having a male thread portion protruding outward of the head from its bottom (not shown). In this embodiment, each of the first and second fasteners 23 and 24 would have only a simple female thread portion as the second thread portion 26.

In the preferable embodiment of the present invention, a plurality of first fasteners 23 that have a respective different mass may be previously prepared. Then one of the first fastener 23 having a suitable mass chosen by a golfer is able to be attached to the first hole 21. Similarly, a plurality of second fasteners 24 that have a respective different mass may be previously prepared. Then one of the second fastener 24 having a suitable mass chosen by a golfer is able to be attached to the second hole 22. Thus, the golfer may adjust the location of the center of gravity of the head according to his or her choice. By exchanging the respective positions of the first and second fasteners 23 and 24, the location of the center of gravity of the head 2 may be adjusted at least in a toe-heel direction of the head 2.

In the present embodiment, although the second hole 22 is provided at toe side with respect to the first hole 21, the position of the second hole 22 is not particularly limited. For instance, the second hole 22 may be provided at the front or rear side with respect to the first hole 21. In another aspect of the embodiment, the first hole 21 and the second hole 22 are preferably spaced at substantially the same distance L1 and L2 from the striking face 9, respectively. This configuration may be available to adjust the location of the center of gravity of the head 2 in a toe-heel direction of the head 2 while maintaining the gravity center of depth of the head.

The distance L1 from the hitting face 9 to the first hole 21, and the distance L2 from the hitting face 9 to the second hole 22 are defined as follows. Firstly, the golf club 1 is placed under a standard condition. The standard condition is a condition to define a golf club to a certain position where the golf club is placed on a horizontal plane with its specified lie, loft and hook angles. The specified lie, loft and hook angles shall mean the lie, loft and hook angles which are defined or identified to the golf club head. Secondary, in bottom view of the head 2 under the standard condition (a planer bottom view of the head projected onto the horizontal plane), a tangent N passing through the leading edge of the lower edge 9*b* of the head 2 is defined. Thirdly, the centroid 21G of the first hole 21 and the centroid 22G of the second hole 22 are determined using the outline of the respective holes 21 and 22. Fourthly, the minimum distance between the tangent N and the centroid 21G is defined as the distance L1, and the minimum distance between the tangent N and the centroid 22G is defined as the distance L2. Preferably, the difference between the distances L1 and L2 may be set in a range of not more than 20% with respect to the largest one of the distance L1 or L2.

Figure 11:
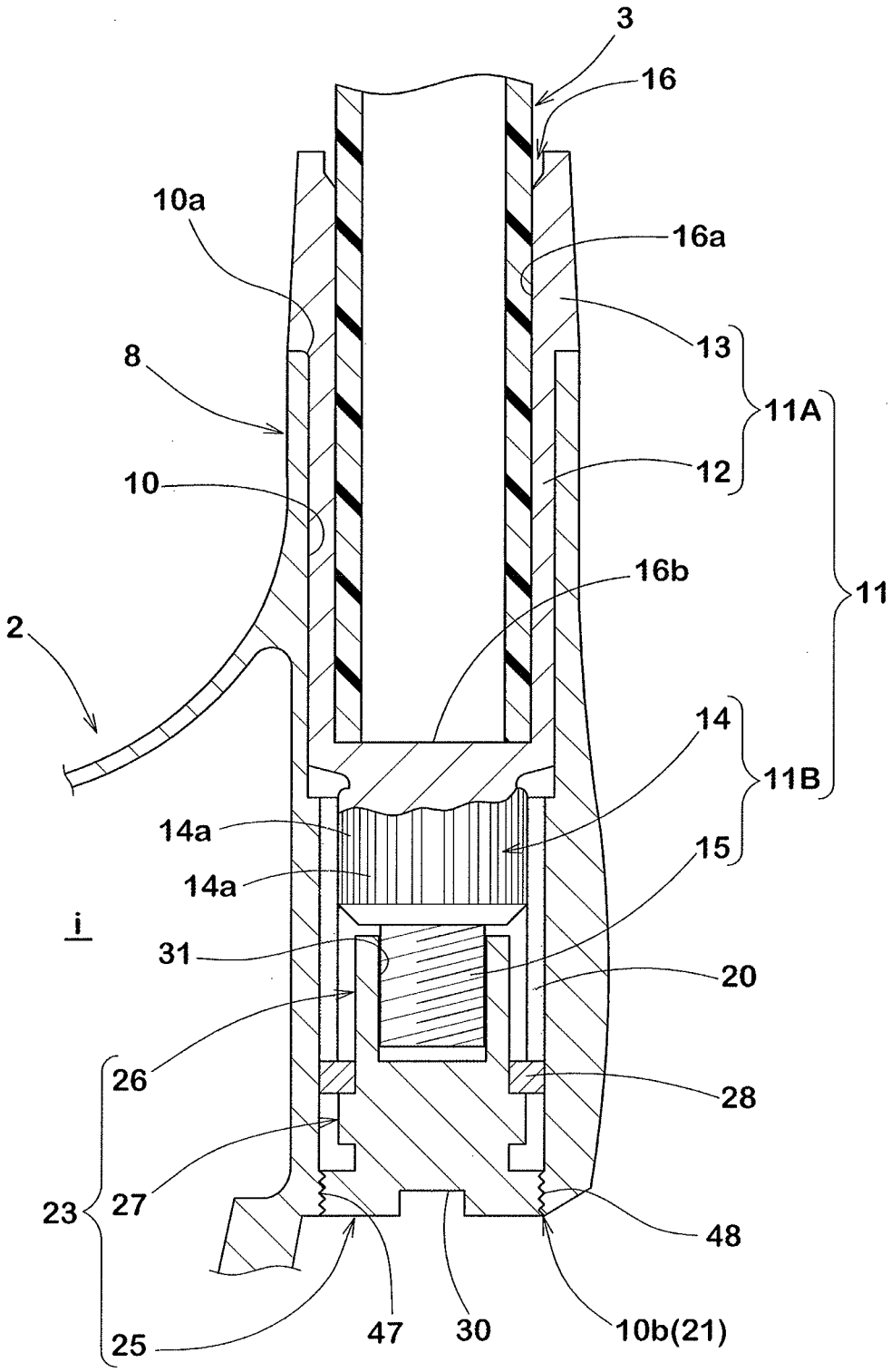
FIG. 11 is a cross-sectional view of a connected portion of a golf club head in accordance with another embodiment of the invention.

FIG. 11 illustrates a cross-sectional view of a connected portion of the golf club head in accordance with another embodiment of the invention. In FIG. 11, those already described above are referred using the same reference numerals, and are omitted the description. In this embodiment, the first hole 21 is provided with a third thread portion 47 which is coaxially arranged in a different place with respect to the first thread portion 15. The third thread portion 47 locates below the first thread portion 15. In this embodiment, the third thread portion 47 is configured as a female thread provided at the entrance of the lower opening 10*b* of the first hole 21, for example.

Each of the first fastener 23 and the second fastener 24 comprises a fourth thread portion 48 which is coaxially arranged in a different place with respect to the second thread portion 26 to engage with the third thread portion 47. The fourth thread portion 48 is configured as a male thread provided at the head 25 of the respective first and second fasteners 23 and 24. In this embodiment, the first fattener 23 is firmly fixed to the first hole 21 due to two independent thread portions which are separately provided in the axial direction. The second hole 22 illustrated in FIG. 7 is embodied without being provided the third thread portion 47.

While the particularly preferable embodiments of the present invention have been described in detail, the present invention is not limited to the illustrated embodiments, but can be modified and carried out in various aspects.

What is claimed is:

1. A golf club comprising:

a golf club head provided with a first hole and a second hole on its bottom side;

a shaft;

a first fastener detachably attached to the first hole to detachably fix the shaft to the golf club head; and a second fastener detachably attached to the second hole to provide weight on the golf club, the second fastener having weight different from that of the first fastener, wherein the first fastener and the second fastener are configured as mutually replaceable fasteners so that the first fastener is detachably attached to the second hole and the second fastener is detachably attached to the first hole to detachably fix the shaft to the golf club head.

2. The golf club according to claim 1, wherein the golf club head comprises a tubular hosel provided with a shaft insertion hole having an upper opening for insertion of the shaft into the golf club head, and a lower opening on the bottom side of the head, and a shaft sleeve adaptor having a first thread portion and inserted into the shaft insertion hole so as to receive a tip end of the shaft, the first hole comprises a space extending from the lower opening of the shaft insertion hole toward the first thread portion of the shaft sleeve adaptor, and each of the first fastener and the second fastener comprises a second thread portion that engages with the first thread portion.

3. The golf club according to claim 2, wherein the first thread portion of the shaft sleeve adaptor is configured as a male thread, and the second thread portion is configured as a female thread.

4. The golf club according to claim 2, wherein the first hole is provided with a third thread portion which is coaxially arranged in a different place with respect to the first thread portion, each of the first fastener and the second fastener comprises a fourth thread portion, and the fourth thread portion is coaxially arranged in a different place with respect to the second thread portion to engage with the third thread portion.

5. The golf club according to claim 1, wherein the second hole comprises an outer portion having a circumferential inner surface including at least one first corner, and an inner portion having a circumferential inner surface including at least one second corner arranged in different place with respect to the first corner in a circumferential direction of the second hole, and the second fastener comprises a flange configured so that the flange firmly engages with the second corner of the inner portion of the second hole by rotating around a central axis of the second hole after passing the outer portion of the second hole.

6. The golf club according to claim 1, wherein the golf club head comprises a hitting face for hitting a golf ball, and the first hole and the second hole are spaced at substantially the same distance from the hitting face.

* * * * *